US010035614B2

(12) United States Patent
van der Meijden et al.

(10) Patent No.: US 10,035,614 B2
(45) Date of Patent: Jul. 31, 2018

(54) METHOD FOR ASEPTIC FILLING OF POUCHES

(71) Applicant: Scholle Corporation, Northlake, IL (US)

(72) Inventors: Wim van der Meijden, Scherpenzeel (NL); J. A. M. Holsink, Hilversum (NL); W. H. Th. Miltenburg, Amersfoort (NL); Sean Fitzgerald, West Dundee, IL (US); Jeroen Pieter Fiere, 's-Gravendeel (NL); Chad Mueller, Aurora, IL (US); Christopher Murray, Chicago, IL (US); David Bellmore, DeWitt, MI (US)

(73) Assignee: Scholle IPN Corporation, Northlake, IL (US)

( * ) Notice: Subject to any disclaimer, the term of this patent is extended or adjusted under 35 U.S.C. 154(b) by 519 days.

(21) Appl. No.: 14/860,683

(22) Filed: Sep. 21, 2015

(65) Prior Publication Data

US 2017/0081064 A1 Mar. 23, 2017

(51) Int. Cl.

| | |
|---|---|
| ***B65B 7/02*** | (2006.01) |
| ***B65B 55/04*** | (2006.01) |
| ***B65B 55/08*** | (2006.01) |
| ***B65B 3/04*** | (2006.01) |
| ***B65B 43/50*** | (2006.01) |
| ***B65B 55/10*** | (2006.01) |

(52) U.S. Cl.

CPC ..... *B65B 55/08* (2013.01); *B65B 3/045* (2013.01); *B65B 7/02* (2013.01); *B65B 43/50* (2013.01); *B65B 55/10* (2013.01)

(58) Field of Classification Search

CPC ..... B65B 55/022; B65B 55/04; B65B 3/045; B65B 3/16; B65B 43/50; B65B 7/02; B65B 7/14

USPC ..... 53/276, 281; 206/277

See application file for complete search history.

(56) References Cited

U.S. PATENT DOCUMENTS

| | | | | |
|---|---|---|---|---|
| 3,499,568 A | | 3/1970 | Vinas Riera | |
| 3,707,823 A | * | 1/1973 | Guckel ..... | B65B 31/025 53/510 |

(Continued)

FOREIGN PATENT DOCUMENTS

| | | |
|---|---|---|
| EP | 694477 A1 | 1/1996 |
| EP | 1291162 A2 | 3/2003 |

(Continued)

*Primary Examiner* — Gloria R Weeks

(74) *Attorney, Agent, or Firm* — The Watson IP Group, PLC; Jovan N. Jovanovic; Vladan M. Vasiljevic

(57) ABSTRACT

A method for filling an aseptic pouch having the steps of: (a) providing a pouch, the pouch including a body having a plurality of panels coupled together to define a cavity, and, a spout providing ingress into the cavity, the spout having a plug sealingly engaged to the spout; (b) cleaning the external surfaces of the pouch with a cleaning preparation; (c) directing the spout and the plug into an aseptic zone, the aseptic zone having a supply of sterilized gas having a positive flow within the aseptic zone; (d) removing the plug; (e) filling the pouch with a flowable material; (f) replacing the plug on the spout to seal the cavity; (g) removing the spout and the plug from the aseptic zone; and (h) coupling the plug to a cap, and the cap to the spout, whereupon removal of the cap removes the plug, providing cavity access.

20 Claims, 7 Drawing Sheets

(56) References Cited

U.S. PATENT DOCUMENTS 4,187,662 A * 2/1980 Cochran ..... B67B 7/00 271/196
4,208,852 A * 6/1980 Pioch ..... B29C 49/46 141/243
4,236,672 A * 12/1980 Koeberle ..... B65B 31/06 141/69
4,338,767 A * 7/1982 Cochran ..... B65B 43/40 271/98
4,394,923 A 7/1983 Sugiyama
4,448,011 A * 5/1984 Pohl ..... B05B 3/0495 134/179
4,458,734 A 7/1984 Scholle et al.
4,726,170 A * 2/1988 Sawa ..... B65B 43/30 53/386.1
5,494,691 A * 2/1996 Sizer ..... B65B 55/14 426/392
5,537,803 A * 7/1996 Olsen ..... B65B 3/30 53/235
5,718,334 A * 2/1998 Demel ..... A61F 9/0008 206/222
5,809,740 A * 9/1998 Sundby ..... B65B 55/08 53/167
5,822,955 A * 10/1998 Woosley ..... B65B 3/28 53/570
5,848,515 A * 12/1998 Catelli ..... B65B 55/02 53/167
5,860,461 A * 1/1999 Helmut ..... B65B 51/142 141/1
6,117,123 A * 9/2000 Barney ..... A61J 1/10 156/308.4
6,126,923 A * 10/2000 Burke ..... A61K 8/02 206/277
6,185,910 B1 * 2/2001 Achhammer ..... B67C 7/0073 134/73
6,203,535 B1 * 3/2001 Barney ..... A61J 1/10 53/452
6,298,638 B1 * 10/2001 Bettle ..... B65B 3/022 53/284.5
6,393,803 B1 * 5/2002 Luka ..... B05D 7/02 117/95
6,517,775 B1 * 2/2003 Wang ..... A23L 3/003 141/89
6,595,391 B1 * 7/2003 Anderson ..... B65B 55/022 222/105
6,629,401 B1 * 10/2003 Hins ..... B65B 7/2892 53/425
6,688,081 B2 * 2/2004 Boyd ..... B65B 3/18 53/331.5
6,752,264 B2 * 6/2004 Versluys ..... B65D 75/5883 206/219
6,923,936 B2 * 8/2005 Swanson ..... A61B 5/1486 206/524.1
7,121,062 B2 * 10/2006 Till ..... B67C 7/0086 53/167
7,140,161 B2 * 11/2006 Till ..... B67C 3/22 53/167
7,341,079 B2 * 3/2008 Zanga ..... B67C 3/22 141/145
7,444,796 B2 * 11/2008 Benedetti ..... A61L 2/208 141/92
7,523,596 B2 * 4/2009 Dovesi ..... B65B 3/003 53/167
7,533,512 B2 * 5/2009 Levati ..... B65B 31/024 53/167
7,536,839 B2 * 5/2009 Kemper ..... A61L 2/22 53/309
7,739,859 B2 * 6/2010 Colato ..... A61L 2/087 53/167
8,006,464 B2 * 8/2011 Krulitsch ..... B67C 3/004 53/253
8,201,688 B2 * 6/2012 Burfiend ..... A47K 5/18 206/277
8,312,984 B2 * 11/2012 Scott ..... B65B 3/04 198/465.4
8,366,855 B2 * 2/2013 Murray ..... B65B 3/04 156/249
8,607,534 B2 * 12/2013 Muehlemann ..... B65B 7/285 53/420
8,621,824 B2 * 1/2014 Mielnik ..... A61L 2/208 422/28
8,844,715 B2 * 9/2014 Lee ..... B65D 51/2864 206/219
9,340,308 B2 * 5/2016 Nakagawa ..... B65B 43/42
9,340,309 B2 * 5/2016 Nakagawa ..... B65B 43/42
9,592,924 B2 * 3/2017 Decio ..... B65B 1/04
9,598,192 B2 * 3/2017 Yoshikane ..... B65B 43/465
9,849,429 B2 * 12/2017 Boissy ..... B01F 3/0861
2004/0187444 A1 * 9/2004 Hutchinson ..... B65B 3/022 53/453
2008/0072547 A1 * 3/2008 Murray ..... B65B 9/08 53/451
2008/0226200 A1 * 9/2008 Murray ..... B65B 3/045 383/7
2009/0013647 A1 * 1/2009 Mastio ..... A61L 2/082 53/425
2009/0028470 A1 * 1/2009 Murray ..... B65D 33/2508 383/80
2009/0056281 A1 * 3/2009 Murray ..... B65B 3/02 53/455
2010/0005760 A1 * 1/2010 Matheyka ..... B65B 55/08 53/426
2010/0107570 A1 * 5/2010 Khan ..... B65B 9/18 53/479
2010/0186348 A1 * 7/2010 Nighy ..... B65B 3/045 53/284.7
2011/0017343 A1 * 1/2011 Murray ..... B08B 9/00 141/1
2011/0017772 A1 * 1/2011 Jacoulet ..... B65D 35/02 222/1
2013/0074452 A1 * 3/2013 Herweck ..... A61F 2/0059 53/432
2013/0160400 A1 * 6/2013 Decio ..... B65B 1/04 53/284.7
2014/0345233 A1 * 11/2014 Parisini ..... B65B 3/045 53/426
2015/0239624 A1 * 8/2015 Chelemedos ..... B65D 47/243 222/92
2017/0158365 A1 * 6/2017 Py ..... A61J 3/002
2017/0311631 A1 * 11/2017 Murray ..... A23L 2/54
2018/0050829 A1 * 2/2018 Borgstrom ..... B65B 7/14

FOREIGN PATENT DOCUMENTS

EP 2418153 A1 2/2012
JP 2002-321715 A 11/2002
JP 2003-072717 A 3/2003
JP 2003-237742 A 8/2003
JP 2006-206159 A 8/2006
JP 2016-8055 A 1/2016
WO 2012055459 A1 5/2012
WO 2016189754 A1 12/2016

* cited by examiner

METHOD FOR ASEPTIC FILLING OF POUCHES

CROSS-REFERENCE TO RELATED APPLICATION

N/A

BACKGROUND OF THE DISCLOSURE

1. Field of the Disclosure

The disclosure relates in general to aseptic filling, and more particularly, to a method for aseptic filling of pouches.

2. Background Art

The filling of flexible packaging and pouches is known in the art. Generally, such filling occurs in an environment wherein the package is handled, opened, filled and then recapped. As requirements have become more stringent, the prospect of aseptic filling of flowable material, namely foodstuffs, has become significantly more important.

Aseptic filling is the filling of a product, for example, a foodstuff, in a sterile container. With the product being sterile as well, the foodstuff can keep for extended periods of time without the use of preservatives and/or refrigeration. Typically, such products are contained in flexible bags (as part of bag in box packaging) or in rigid packaging containers such as blown polymer bottles, or cartons made from paperboard laminations.

Problematically, it has been difficult to utilize standup pouches with fitments in the aseptic filling process. In particular, pouches tend to be difficult to sterilize and it has been costly to apply threaded closures to such packaging. Indeed, a cost effective solution for aseptic filling of standup pouches having fitments has been a challenge.

SUMMARY OF THE DISCLOSURE

The disclosure is directed to a method for filling an aseptic pouch comprising the steps of: (a) providing a pouch, the pouch including a body having a plurality of panels that are coupled together to define a cavity, and, a spout providing ingress into the cavity, the spout having a plug sealingly engaged to the spout, thereby precluding access into the cavity; (b) cleaning the external surfaces of the pouch with a cleaning preparation; (c) directing the spout and the plug into an aseptic zone, the aseptic zone having a supply of sterilized gas having a positive flow within the aseptic zone; (d) removing the plug; (e) filling the pouch with a flowable material; (f) replacing the plug on the spout to seal the cavity; (g) removing the spout and the plug from the aseptic zone; and (h) coupling the plug to a cap, and the cap to the spout, whereupon removal of the cap removes the plug and provides access to the cavity.

In some configurations, the step of cleaning comprises the step of: (a) positioning the pouch on a rail having a first end and a second end; (b) translating the pouch along a rail from the first end to the second end; and (c) directing a cleaning preparation at the pouch between the first end and the second end.

In some configurations, the method further comprises the steps of: (a) positioning the pouch on a rotary filler having a plug removing station after the step of cleaning the external surfaces and the step of translating the pouch to the second end, a filling station and a plug replacement station, the stations being angularly displaced along the rotary filler; (b) rotating the pouch within the rotary filler after the step of removing from the plug removing station to the filling station; and (c) rotating the pouch within the rotary filler after the step of filling from the filling station to the plug replacement station.

In some configurations, the method further comprises the step: rotating the pouch within the rotary filler after the step of replacing the plug prior to the step of removing.

In some such configurations, the step of removing the plug further comprises the step of placing the plug proximate the pouch, so that, in turn, the plug rotates with the pouch on the rotary filler.

In some such configurations, the step of removing the plug further comprises pulling the plug from the spout, wherein the plug is coupled to the spout through an interference fit that forms a hermetic seal.

In some such configurations, the step of rotating the pouch within the rotary filler further comprises rotating the pouch through retention of the spout.

In some such configurations, the step of coupling further comprises the steps of: (a) receiving the pouch on a rotary capper having a capping head; (b) rotating the pouch to the capping head prior to the step of coupling; (c) rotating the pouch away from the capping head after the step of coupling; and (d) discharging the pouch from the rotary capper.

In some such configurations, the step of coupling further comprises the step of rotatably coupling the cap to the spout, and the step of fixedly engaging the plug with the cap.

In some configurations, the step of providing the pouch further comprises the step of pre-sterilizing the cavity. In some such configurations, the step of pre-sterilizing comprises the step of pre-sterilizing the cavity through at least one of gamma, x-ray and e-beam radiation.

In another aspect of the disclosure, the disclosure is directed to a method for filling a plurality of aseptic pouches comprising the steps of: (a) providing a plurality of pouches, each pouch including a body having a plurality of panels that are coupled together to define a cavity, and, a spout providing ingress into the cavity, the spout having a plug sealingly engaged to the spout, thereby precluding access into the cavity; (b) cleaning the external surfaces of the plurality of pouches with a cleaning preparation; (c) sequentially directing the spout and the plug of each of the plurality of pouches into an aseptic zone, the aseptic zone having a supply of sterilized gas having a positive flow; (d) directing the plurality of the plurality of pouches into a rotary filler, the rotary filler having a plurality of plug removing stations, a plurality of filler stations, and a plurality of plug replacement stations; (e) firstly rotatably directing the plurality of pouches into one of the plurality of plug removing stations; (f) removing the plug in the plug removing stations substantially simultaneously; (g) secondly rotatably directing the plurality of pouches from the plug removing stations to the plurality of filler stations; (h) filling each of the plurality of pouches with a flowable material in the filler stations substantially simultaneously; (i) thirdly rotatably directing the plurality of pouches from the plurality of filler stations to the plurality of plug replacement stations; (j) replacing the plug on the spout of each of the plurality of pouches to seal each cavity in the plug replacement stations substantially simultaneously; (k) removing the plurality of pouches from the aseptic zone; (l) fourthly rotatably directing the plurality of pouches into a rotary capper, the rotary capper having a plurality of capping heads; and (m) coupling the plug to the cap and to the spout in releasable engagement in the rotary capper, substantially simultaneously, whereupon removal of the cap simultaneously removes the plug and provides access to the cavity.

In some configurations, the plurality of plug removing stations, the plurality of filler stations and the plurality of plug replacement stations comprises an identical quantity. In some such configurations, the identical quantity comprises four.

In some configurations, the plurality of capping heads comprises four capping heads.

In some configurations, the step of removing the plug further comprises the step of: placing each of the plurality of plugs adjacent a respective one of the plurality of pouches from which the plug was removed.

In some configurations, the steps of second rotatably directing, and thirdly rotatably directing further comprises the steps of first and second rotatably directing the plug of each of the plurality of pouches.

In some such configurations, the step of coupling the plug further comprises the step of coupling the plug that was removed from each of the plurality of pouches on to the same pouch from where the respective plug was removed.

In some configurations, the body of the pouch remains outside of the aseptic zone, while the spout and the plug are within the aseptic zone.

In some configurations, the step of providing further comprises the step of pre-sterilizing the cavity, which can, but is not required to be carried out by gamma, x-ray and/or e-beam radiation.

BRIEF DESCRIPTION OF THE DRAWINGS

The disclosure will now be described with reference to the drawings wherein.

DETAILED DESCRIPTION OF THE DISCLOSURE

Figure 1:
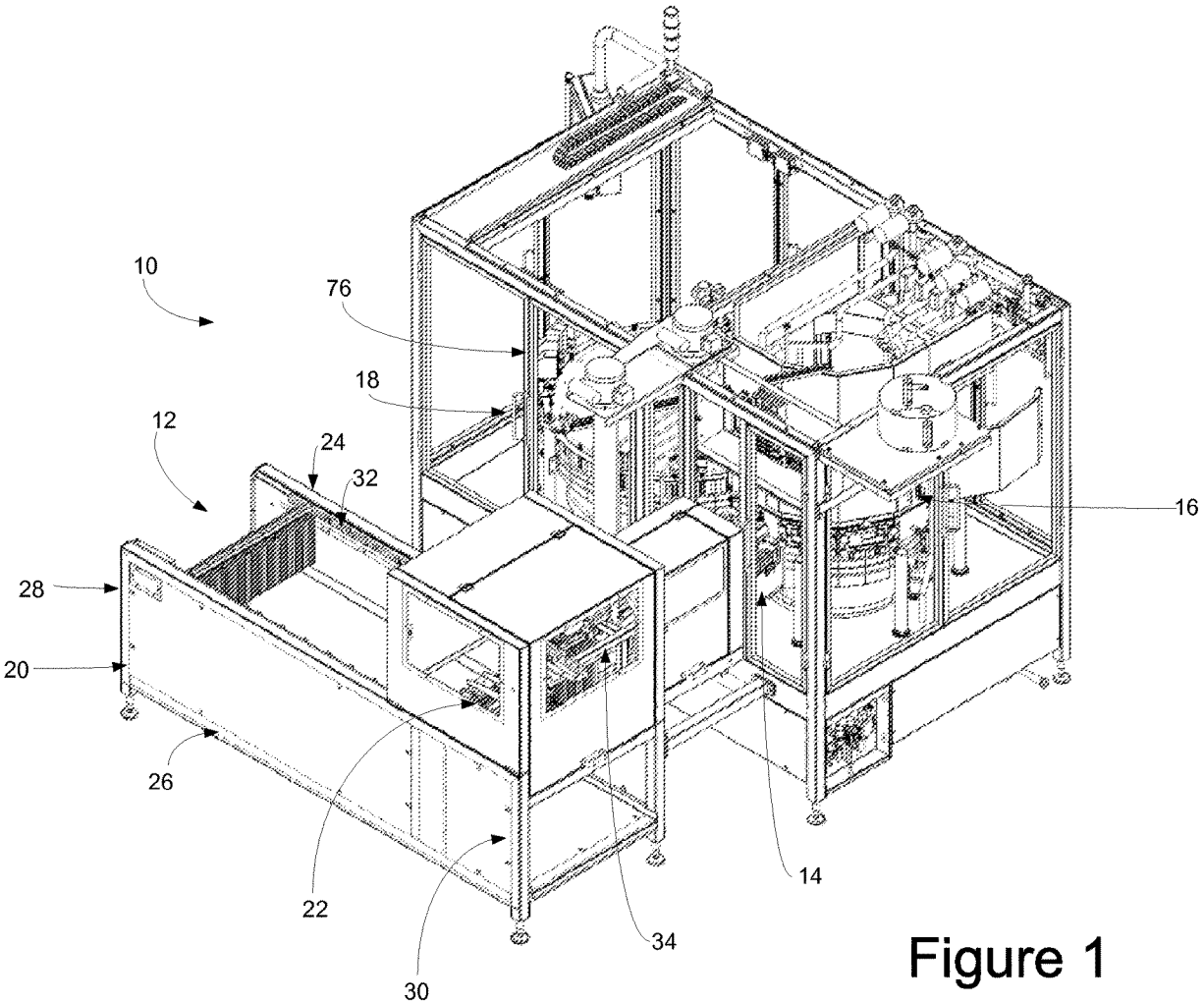
FIG. 1 of the drawings is a perspective view of the an aseptic pouch filler for use in association with the method of aseptic filling of pouches of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, the aseptic pouch filler equipment, for filling an aseptic pouch, is shown generally at 10. The aseptic pouch filler equipment includes cartridge filling assembly 12, pouch cleaning assembly 14, pouch fill assembly 16 and pouch capping assembly 18. The aseptic pouch is directed sequentially through each of the foregoing assemblies so as to be cleaned and filled. The pouch cleaning assembly directs the cleaned pouch into the pouch fill assembly which is maintained within an aseptic zone. It will be understood that an aseptic zone comprises a zone that is under a positive flow of sterilized gas (typically sterilized air), and that has been cleaned to aseptic standards such as those disclosed in Title 21 of the Code of Federal Regulations pertaining to thermally processed low acid foods packaged in hermetically sealed containers overseen by the U.S. FDA, as well as 3-A Sanitary Standards, Inc. and European Hygienic Engineering and Design Group (EHEDG) Standards.

Figure 3:
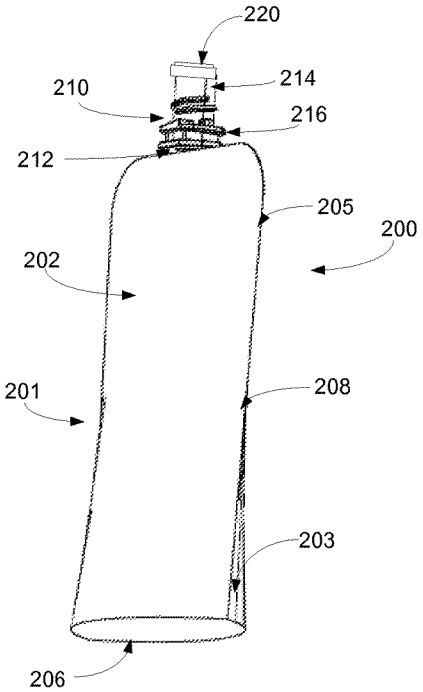
FIG. 3 of the drawings is a perspective view of a pouch of the type filled by the aseptic pouch filler of FIG. 1.

A typical pouch with which the system is associated is shown in FIG. 3 generally at 200. As will be understood, the pouch (in a capped configuration) is pre-sterilized prior to introduction into the filler equipment 10 through, for example, gamma, x-ray, e-beam or other sterilization process, such that the internal cavity of the pouch is free of pathogens and a sterile environment. The pouch 200 includes body 201 and spout 210. The body 201 includes first side panel 203, second side panel 204, lower gusset structure 206. The first side panel, the second side panel and the lower gusset structure are coupled together through seals 208 to form cavity 205 configured to retain a flowable material, such as a foodstuff or the like. In many configurations, the gusset structure 206 provides a base surface from which the pouch can be in a standup configuration. Of course, in other configurations, the pouch can be formed from a plurality of panels greater than two panels or from a single panel along with a plurality of folds, wherein the panels cooperate to form the gusset at the lower end thereof. Furthermore, additional structures or gussets (such as side gussets) or gussetless constructions are likewise contemplated). Typically, the cavity is on the order of 60 ml to 500 ml in size. More preferably, the cavity is on the order of 60 ml and 180 ml in size, and more preferably, the cavity is on the order of 90 ml to 120 ml. Of course, variations are contemplated, and the foregoing cavity volumes are exemplary only, and not considered to be limiting. Prior to introduction into the cartridge filling assembly, the pouches have been sterilized through gamma sterilization or the like. As such, the cavities are free of pathogens, and are a sterile environment. The plug has a hermetic seal thereby precluding the passage of material into (or out of) the spout. Generally, such pouches are formed from a multi-layer polymer structure that may include metal or metallized layers, and which may be co-extruded and/or laminated.

Spout 210 is shown as comprising attachment flange 212, outlet tube 214 and grasping flanges 216. The attachment flange (often referred to as a sealboat) is typically sandwiched between the first and second side panels and sealed thereto. The outlet tube 214 provides communication with the cavity 205 and provides the means by which to insert or remove flowable material to and from the cavity. In the configuration shown, the outlet tube 214 is capped with a plug 220 which may extend over the outer surface of the outlet tube 214 or within the confines of the outlet tube to preclude access to the cavity 205. It will be understood that a hermetic seal is formed between the plug and the outlet tube through an interference fit. The grasping flanges 216 extend about the outside of the outlet tube. The grasping flanges provide slots and channels by which the pouch can be grasped, retained, handled, and/or captured by different components of the filling equipment.

Figure 4:
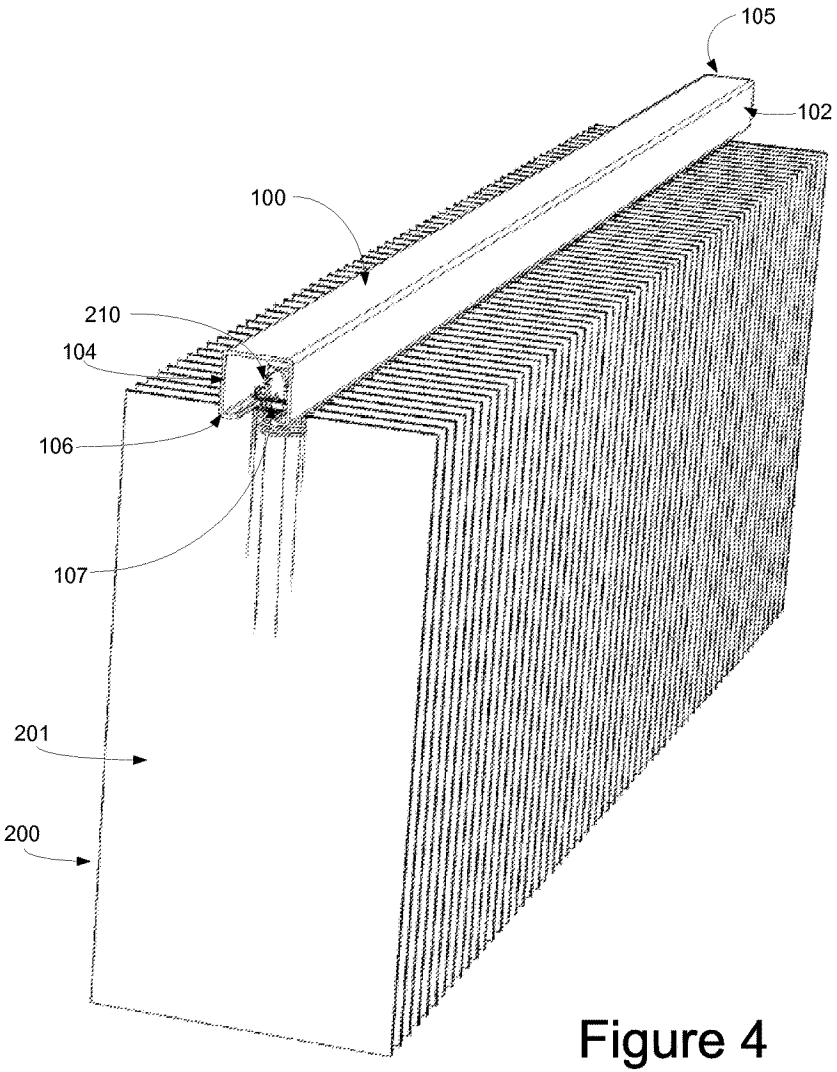
FIG. 4 of the drawings is a perspective view of a plurality of pouches for use in the aseptic pouch filler of FIG. 1, coupled together within a cartridge.

The cartridge filling assembly 12 is shown in FIG. 1 as comprising frame 20 and feeder 22. The frame includes first side rail 24, second side rail 26, first end 28, second end 30 and a system for advancing the cartridges 32. The frame is configured to retain a plurality of cartridges, such as cartridge 100 (FIG. 4). With further reference to FIG. 4, such a cartridge 100 includes an elongated body 102, having opposing ends 104, 105 (it will be understood that stoppers or other structures may be employed to limit or prevent the removal of the pouches during transport and/or shipping). Opposing rails 106 extend along the body between the first end and the second end, defining central slot 107. It will be understood that the cartridges are retained by the spout, so that flanges of the spout are captured by the opposing rails so that a pouch can be directed along the opposing rails from the first end to the second end. More particularly, the rails extend, typically, between adjacent grasping flanges of the spout 210 and are maintained therebetween. The cartridges are essentially a handling mechanism for handling such pouches for transport and insertion into the filling equipment. Of course, other methods and equipment for sequentially, or batch inserting pouches into filling equipment is likewise contemplated.

Figure 7:
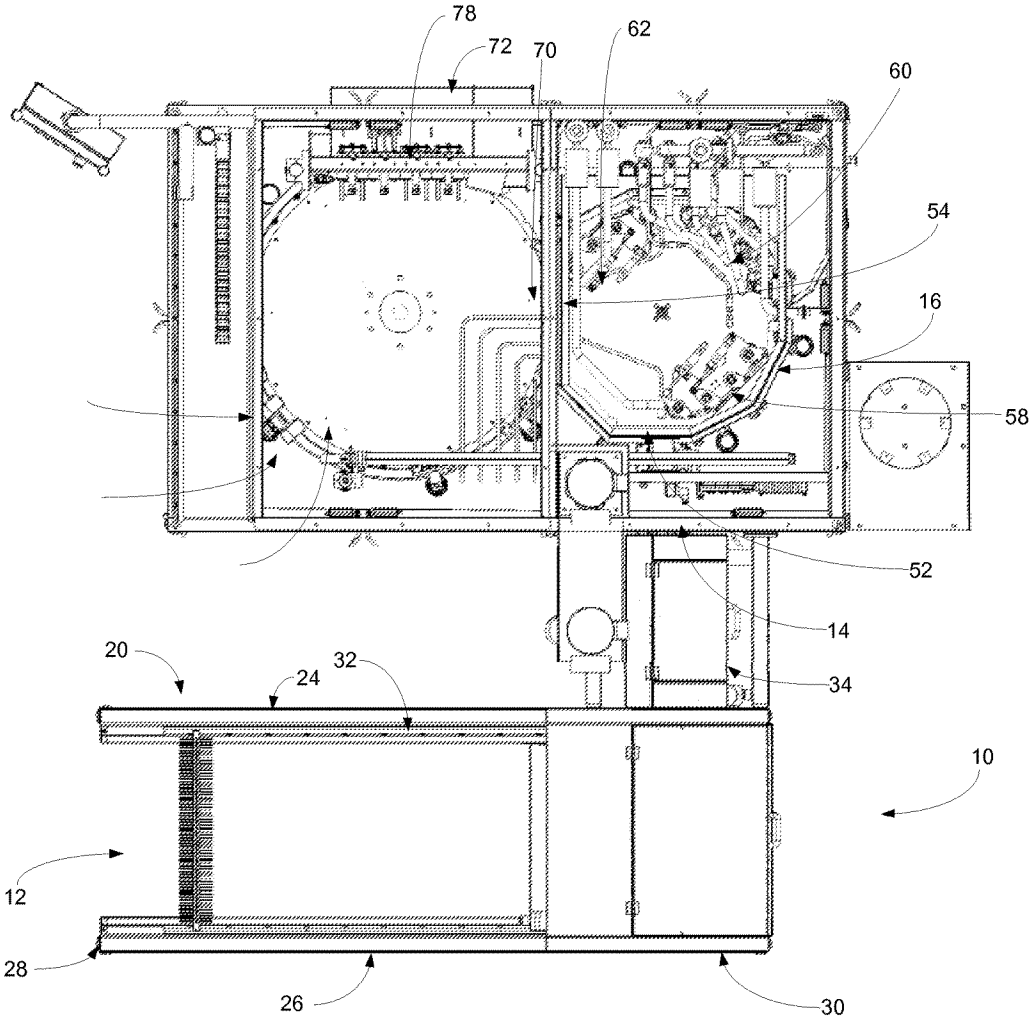
FIG. 7 of the drawings is a top elevational view of the aseptic pouch filler of FIG. 1, showing, in particular, the cartridge filling assembly, the pouch cleaning assembly, the pouch fill assembly and the pouch capping assembly.

With reference to FIGS. 1 and 7, collectively, in the configuration shown, the opposing first and second side rails 24, 26 receive the cartridges in a transverse manner, sequentially. That is, the first end of the cartridge is coupled to the first side rail and the second end of the cartridge is coupled to the second side rail of the cartridge. The cartridge is initially positioned at the first end 28 of the frame, or between the first and second ends of the frame. It is then directed toward the second end 30 of the frame until it reaches the loader 22. It will be understood that a number of different configurations of the frame are contemplated. That is, the frame can be configured to retain any number of cartridges, for example, in sequential, side by side orientation. In the configuration shown, a mechanism is provided at one or both of the side rails 24, 26, to advance the cartridge (in the transverse orientation shown) toward the second end, and, more particularly, toward the loader 22.

The loader 22 includes a transverse feeder 34. The loader is configured to direct the pouches sequentially along the rail of the cartridge into the pouch cleaning assembly 14. The loader 22 is preferably outside of the aseptic zone, but directs the pouches sequentially into the pouch cleaning assembly that cleans the outside surfaces prior to introduction into the aseptic zone. It will be understood that through the configuration shown, when the pouch is directed into the aseptic zone, the spout is maintained within the aseptic zone (at least a portion thereof), while the pouch itself is maintained outside of the aseptic zone.

Figure 2:
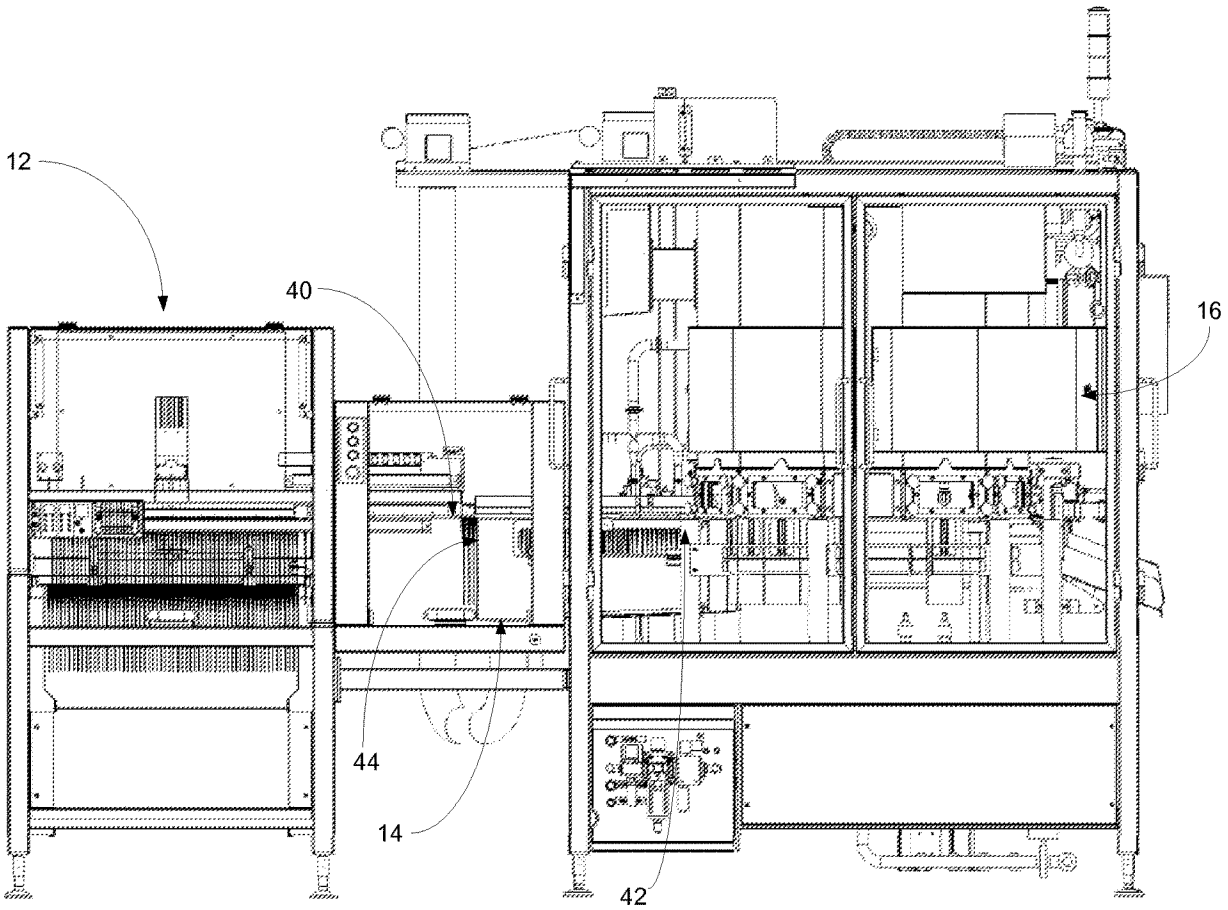
FIG. 2 of the drawings is a side elevational view of the aseptic pouch filler for use in association with the method of aseptic filling of pouches of the present disclosure.
Figure 5:
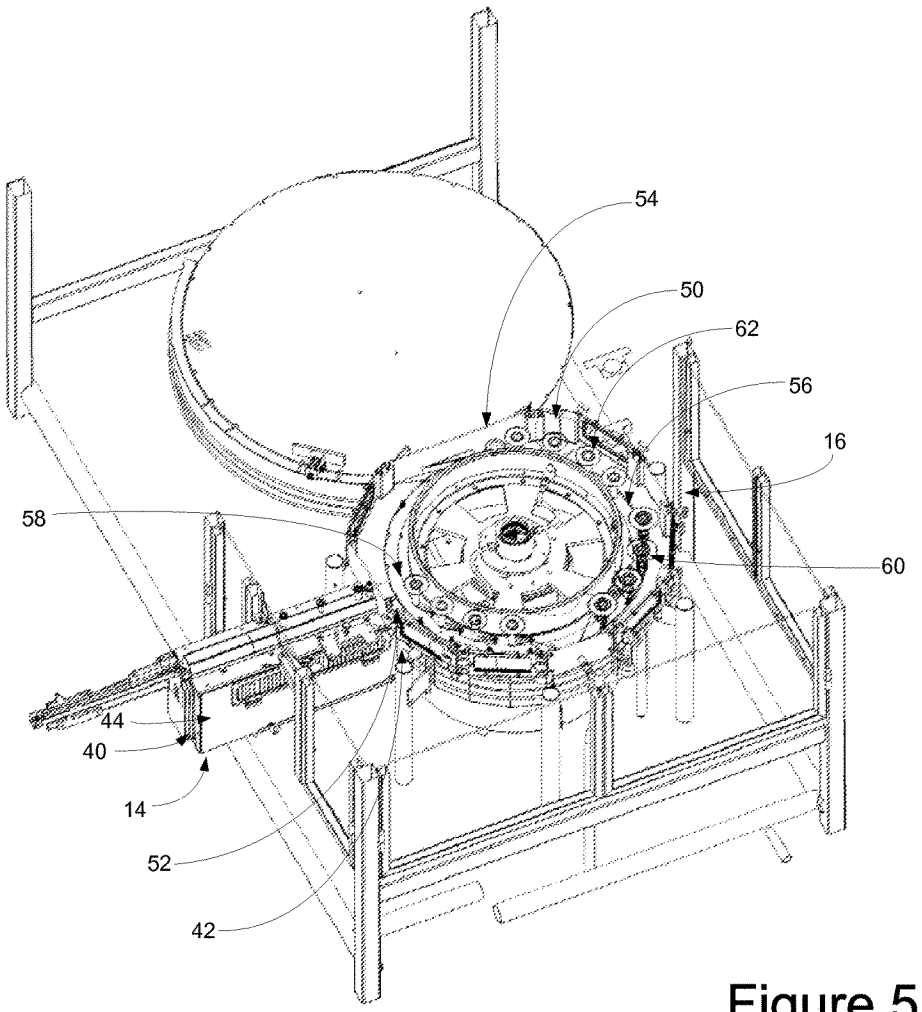
FIG. 5 of the drawings is a partial cross-sectional view of the aseptic pouch filler of FIG. 1, showing, in particular, the pouch cleaning assembly and the pouch filling assembly.
Figure 6:
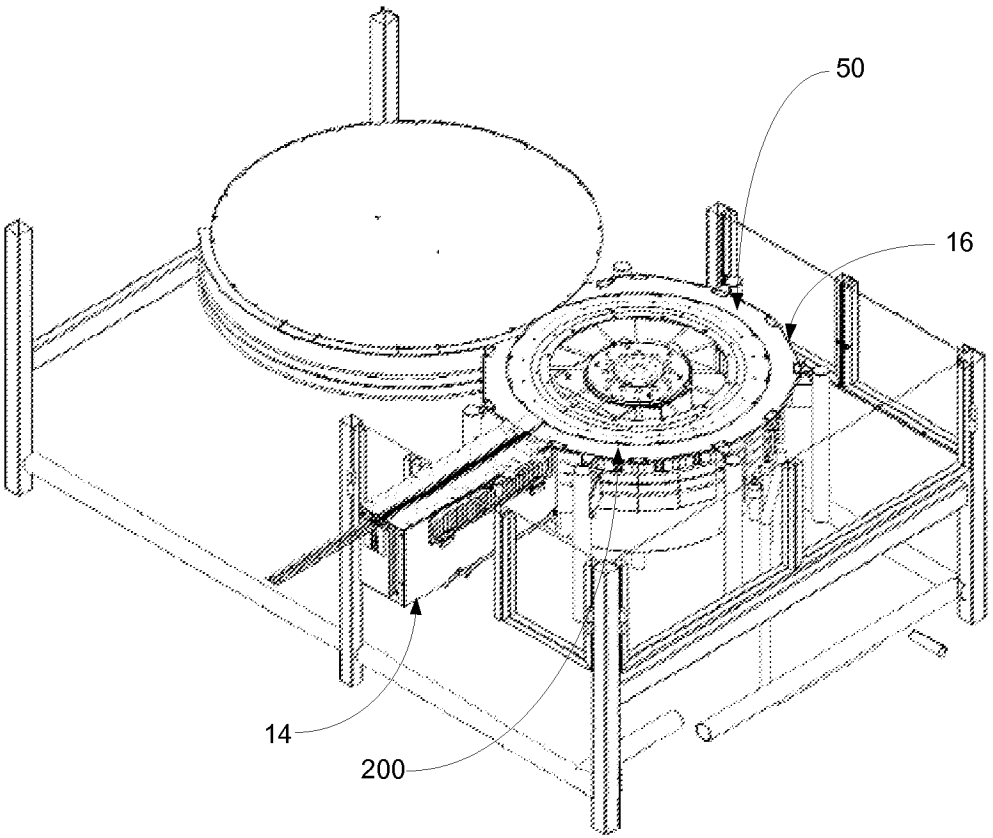
FIG. 6 of the drawings is a partial cross-sectional view of the aseptic pouch filler of FIG. 1, showing, in particular, the pouch cleaning assembly and the pouch filling assembly, and more particularly, the movement assembly of the pouch fill assembly capturing the spouts of the pouches in sealed engagement, to, in turn, maintain the spout within the aseptic zone, with the body outside of the aseptic zone.

The pouch cleaning assembly 14 is shown in FIGS. 2, 5 and 6, as comprising pouch inlet 40, pouch outlet 42 and treatment chamber 44. The pouches are received from the loader 22 at inlet 40, and pass through to pouch outlet 42. The pouches travel along another rail configuration that captures various ones of the grasping flanges 216 (FIG. 3) of the spout of the pouch. In the configuration shown, the pouches essentially depend downwardly, as the pouch is maintained and directed within the treatment chamber 44 by way of communication and connection with the spout.

Within the treatment chamber, the pouches are exposed to chemical treatment, through, for example, a cleaning preparation (in the form of a vapor, a liquid, a gas or a combination thereof). In the configuration shown, it is contemplated that a hydrogen peroxide vapor is transmitted through the treatment chamber at an elevated temperature in a directed manner to clean the surfaces of the pouch. In other configurations, different fluids and mechanisms may be utilized in order to effectuate cleaning. That is, gasses, or other combinations of gasses, vapors, liquids and the like can be utilized.

With reference to FIGS. 1, 2 and 5-8, once the pouch is clean, the pouch can be moved to the pouch fill assembly 16. The pouch fill assembly 16 includes aseptic zone 50, inlet 52, outlet 54, movement assembly 56, plug removing stations 58, fill stations 60 and plug replacement stations 62. The pouch fill assembly 56 is maintained within the aseptic zone, and includes aseptic zone 50 that extends therearound. A positive flow of sterilized air is maintained and the surfaces are sterilized prior to filling. The movement between inlet 52 and outlet 54 defines the aseptic zone in the present filler disclosed.

The pouch fill assembly, and in particular, the movement assembly 56 comprises a rotary fill wherein the pouches are configured to rotate about a circumference from the inlet, sequentially to the plug removing stations, the fill stations and the plug replacement stations, ultimately directed to the outlet. In the configuration shown, the movement assembly 56 captures and controls the movement of the pouch through the rotary filler.

In the configuration shown, the inlet 52 is positioned to receive, sequentially, pouches from the pouch cleaning assembly, and is mounted proximate the outlet of the pouch cleaning assembly. Next, the plug removing stations are configured in an angularly spaced apart orientation along the path along which the pouches travel within the movement assembly. In the configuration shown, a total of four plug removing stations are positioned in such an orientation. As will be explained, the process is completed sequential with four pouches, that is, a pouch on each of the four plug removing stations.

At each of the plug removing stations, the plug remover is configured to remove the plug 220 from the spout of each container, and to place the plug adjacent to the pouch and along the movement assembly, so that the plug travels rotatably through the rotary filler together with the pouch.

The fill stations 60 are arranged in an angularly spaced apart orientation along the path of travel of the pouch through the rotary filler. As with the plug remover, a total of four spaced apart fill stations 60 are shown. The spacing is preferably the same as with the plug remover spacing, and as such, when the first set of four uncapped pouches are directed into the fill stations, a new set of four pouches can be introduced into the plug removing stations. The fill stations are configured to simultaneously fill the four pouches with the flowable material.

The plug replacement stations 62 are positioned in an angularly spaced apart orientation along the path of travel of the pouch through the rotary filler. As with the fill stations, a total of four spaced apart plug replacement stations are shown. The spacing is preferably the same as with the fill stations, and, as such, when the first four pouches are directed from the fill stations to the plug replacement stations, the subsequent four pouches are directed from the plug remover stations to the fill stations, and four new pouches are directed from the pouch cleaning assembly to the plug remover stations. The plug replacement stations 62 each grasp the respective plug that has been travelling with the respective pouch, and transfer the plug onto the pouch, to recap the same.

Figure 8:
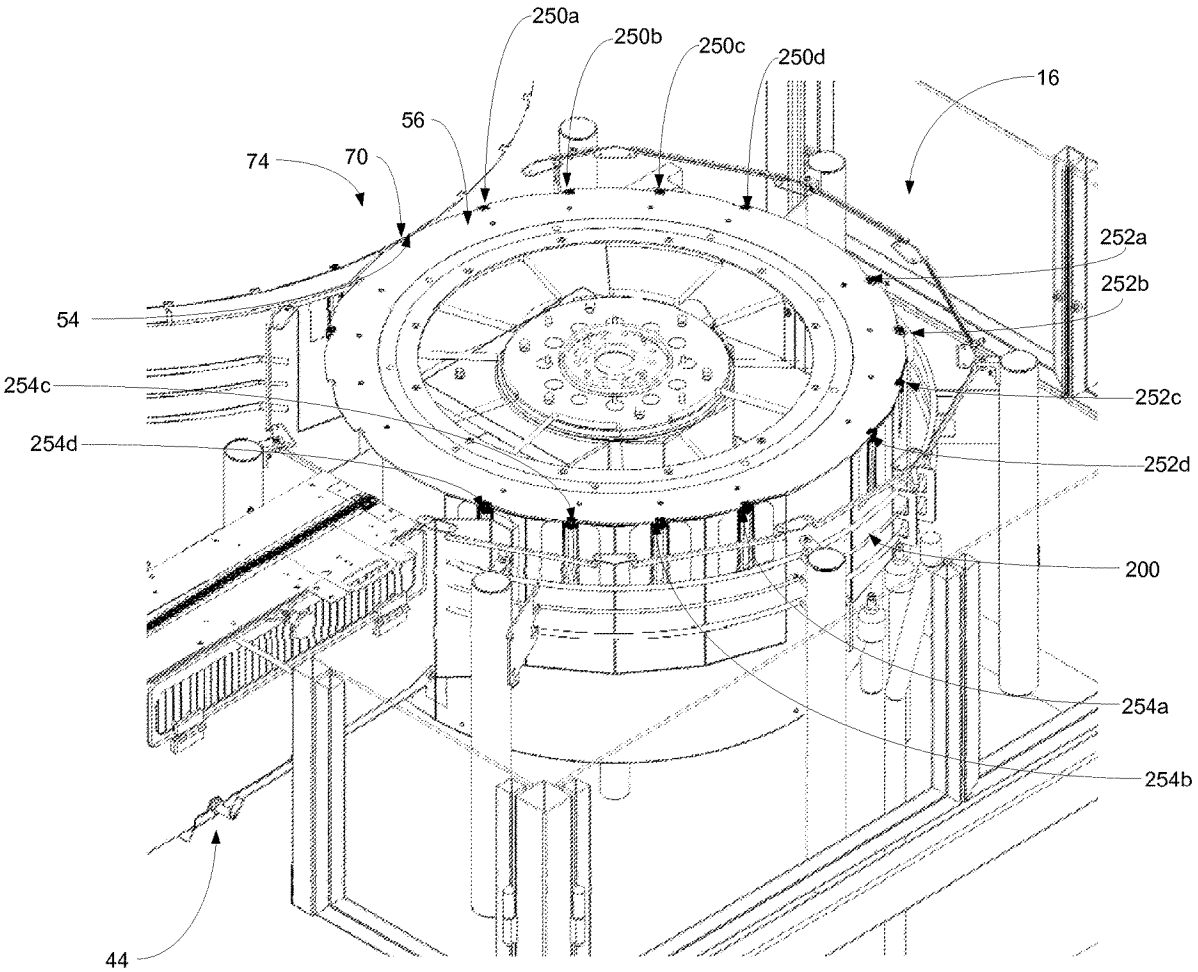
FIG. 8 of the drawings is a partial cross-sectional view of a portion of the movement assembly of the pouch fill assembly, showing, in particular, the inner retention of the pouches within the aseptic zone of the pouch fill assembly.

With reference to FIGS. 1, 7 and 8, the pouch capping assembly 18 comprises a rotary capper, which is tangentially positioned relative to the rotary filler such that the accepting region 70 of the pouch capping assembly corresponds to the outlet 54 of the pouch fill assembly. As such, after the pouches have been filled and recapped, the pouches are rotated to the outlet 54 and into contact with the accepting region 70 of the pouch capping assembly. At such time, they are captured by the pouch capping assembly. The pouch capping assembly likewise includes a movement assembly 74 which rotatably moves the pouches through the pouch capping assembly. The pouch capper is outside of the aseptic zone, and the transfer at the outlet of the pouch fill assembly forms the outlet from the aseptic zone into the non-aseptic zone. It will be understood that as the pouch exits from the rotary capper, the pouch has been coupled to a cap introduced by the rotary capper.

As with the pouch fill assembly features, a total of four capping heads are presented along the movement assembly positioned along the travel of the pouches through the rotary capping configuration. The pouches are directed to the capping heads of the capping station, wherein the caps are, preferably, rotatably installed onto the pouch (although it is contemplated that they may be pressed into position, but are threaded, so that uncoupling occurs through a threaded engagement). In such a configuration, the caps are coupled to the spout of the pouch and also coupled to the plug. It will be understood that the cap is generally substantially permanently coupled to the plug, while being removably coupled to the spout. That is, when the cap is removed from the spout, the plug is removed along with the cap. For example, the cap can be press fit in a substantially non-releasable manner to the plug at the same time that the cap is coupled to the spout during the capping procedure within the capping station. Once coupled (often a snap fit or the like), the two structures are maintained in such a configuration, and separation of the components is typically achieved through distortion and/or destruction of one of the plug and the cap, or both.

The pouch capping assembly 18 includes a removal station, wherein the pouch that has been capped can be removed from within the capping station. Once removed from within the capping station, the pouch is fully filled and capped with a removable cap that can be removed to provide access to the cavity of the pouch. Significantly, the cap, its configuration, can change, as can the ornamental appearance of the same. Such changes may necessitate altering the capping stations, however, the same type of plug can be utilized in such configurations. As such, the pouch cleaning assembly and the pouch fill assembly (which is within the aseptic zone) can remain unchanged, and, therefore free from alterations. It will be understood that any alterations or other amendments to the process may impact the aseptic zone in a negative manner, and may not insure that the pouches will be properly cleaned and filled.

The process and method of utilizing the aseptic pouch filler equipment and method will be set forth below, with the understanding that variations thereto are contemplated.

Typically, cartridges are provided with a plurality of pouches positioned along the opposing rails of the elongated body. For example such cartridges may hold somewhere between twenty and eighty, and more preferably twenty-five to fifty-one pouches therealong. Cartridges are positioned on the cartridge filling assembly sequentially. It is often the case that the cartridge filling assembly is continuously sequentially filled with cartridge after cartridge. Each cartridge passes along the opposing side rails to the loader. It will further be understood that the pouches (fully capped with cap 220) are sterilized through gamma, x-ray, e-beam radiation or other sterilization process prior to introduction into the filler so that they internal cavity thereof is sterile and free of pathogens.

At the loader, the transverse feeder directs the pouches along the opposing rails of the cartridge into the pouch cleaning assembly. Within the pouch cleaning assembly, the pouches can be stationary, continuously moving, or sequentially moving in increments. The pouch cleaning assembly directs a fluid (typically, a vapor, a liquid, a gas or a combination of the foregoing) at various portions of the pouch. Of particular concern are not only the flat surfaces, but the nooks and crannies of the spouts. In the configuration shown, the spout is maintained within the pouch cleaning assembly. The pouches themselves, that is the body of the pouch, is preferably maintained outside of the pouch cleaning assembly.

As the pouch is passed to the pouch fill assembly, the contact is maintained with the spout, and the spout is positioned so that a portion thereof is within the aseptic zone, whereas the body of the pouch is below the movement assembly, and in turn, outside of the aseptic zone. The less of the overall pouch that is introduced into the aseptic zone, the less possible contaminants have the possibility to be directed into the aseptic zone.

As the pouches exit from the pouch cleaning assembly, the pouches are directed into the fill assembly. Again, the pouches are handled by the spout and the spout is maintained within the aseptic zone. The pouch fill assembly (and the pouch capping assembly) are each configured to handle four pouches simultaneously through each of the stations. Thus, when the system is initiated, the first four spouts are directed from the pouch cleaning assembly into the pouch fill assembly, and directed sequentially to each of the four plug removing stations within the pouch fill assembly.

As explained above, the plug removing stations remove the plug from each of the four pouches and place the plugs on a stand or other temporary holding device that is positioned proximate to the pouch so that it travels with the pouch. The same plug that is removed is preferably repositioned on the same pouch after filling. Advantageously, a separate supply of plugs is not necessary nor are special handling needs of the pouches. Once the plugs are removed from each of the pouches and positioned proximate the pouches (and within the aseptic zone), the four pouches are rotated along with the movement assembly (and the associated spouts) from the plug removing station to the filling stations. The filling heads of the filling stations coact with the spouts to direct the appropriate amount of flowable material into the pouches.

At the same time that the first four pouches rotated from the plug removing station to the filling station, four pouches of a second group of pouches exited from the pouch cleaning assembly and were directed into the plug removing stations.

Thus, while the first four pouches are being filled, within the plug removing station, the plugs of the second set of pouches have been removed and placed proximate each of the pouches from which they were removed.

Once the first four pouches have been filled, and once the second group of pouches has had their plug removed, the pouches are again rotated within the aseptic zone so that the first four pouches are positioned at the four plug replacement stations, the second set of pouches are at the filling stations and a third set of pouches has been directed from the pouch cleaning assembly into the plug removing station of the fill assembly. At such time, each of the four positions of the plug removing station, the filling station and the plug replacement station have a respective pouch associated therewith.

The first pouches, positioned within the plug replacement station, are recapped with the plugs. The plugs provide a hermetic seal over the outlet tube. In the configuration shown, the plugs removed from a respective one of the pouches, being positioned in close proximity, are returned to the same pouch from which removed, after filling. At the same time, the second set of pouches is filled at the filling station, and the plugs from the third set of pouches are being removed at the plug removing station.

With the first four pouches being filled and the plug being replaced onto the spout, the first four pouches are transferred from the movement assembly of the pouch fill assembly to the movement assembly of the pouch capping assembly. As the transfer to the pouch capping assembly is made, the pouch travels out of the aseptic zone. The second set of pouches which were filled by the filling stations travel to the plug replacement stations to have the plugs replaced thereon. The third set of pouches travel from the plug removing station to the filling station to be filled. A fourth set of pouches is directed from the pouch cleaning assembly to the pouch fill assembly, and to the plug removing stations therewithin.

This cycle continues within the pouch cleaning assembly and the pouch fill assembly as sequential groups of four pouches are directed from the pouch cleaning assembly to the pouch fill assembly.

With the first four pouches in the pouch capping assembly, the pouches are directed to the capping station, wherein the four pouches are capped with a cap that is rotatably coupled to the pouch, and fixedly engaged with the plug. As set forth above, the coupling to the plug is intended to be a coupling that is generally not removable. Thus, when the cap is removed from the pouch to provide ingress into the cavity, the plug remains coupled to the cap and is removed with the cap simultaneously.

Once the cap has been placed onto the spout and coupled to the plug, the movement assembly of the pouch continues to rotate, thereby directing the capped pouches out of the pouch capping assembly through the outlet thereof. At the same time, the second set of pouches is entering the pouch capping assembly and the process is repeated.

It will be understood that the process is shown in a manner wherein four pouches are simultaneously positioned in a particular station. That is, each of the stations includes four positions or ports for accepting pouches. It will be understood that the disclosure is not limited to the processing of four pouches simultaneously in each of the stations. A greater or lesser amount of positions can be provided at any one of the stations. In addition, it will be understood that the stations can be in an orientation that is other than a rotary filling configuration (such as a batch or linear filler). Advantageously, the rotary filling and the rotary capping allows for the sequential movement of multiple pouches through the filling and capping process.

Additionally, such a configuration allows for the alteration of the body of the pouch (i.e., shape and size), as well as the type of cap that is utilized, without requiring a change to the aseptic zone. As a result, the method has a substantially greater flexibility and minimizes the chance that changes are required to the aseptic zone, and, in turn, disruption to the aseptic zone are required. Often such changes may be a contributing factor to a condition wherein the aseptic nature of the zone is compromised or altered in such a way that aseptic conditions are no longer present, or prevalent.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A method for filling an aseptic pouch comprising the steps of:

providing a pouch, the pouch including a body having a plurality of panels that are coupled together to define a cavity, and, a spout providing ingress into the cavity, the spout having a plug sealingly engaged to the spout, thereby precluding access into the cavity;

cleaning the external surfaces of the pouch with a cleaning preparation;

directing the spout and the plug into an aseptic zone, the aseptic zone having a supply of sterilized gas having a positive flow within the aseptic zone;

removing the plug;

filling the pouch with a flowable material;

replacing the plug on the spout to seal the cavity;

removing the spout and the plug from the aseptic zone; and coupling the plug to a cap, and the cap to the spout, whereupon removal of the cap removes the plug and provides access to the cavity.

2. The method for filling of claim 1 wherein the step of cleaning comprises the step of:

positioning the pouch on a rail having a first end and a second end;

translating the pouch along a rail from the first end to the second end; and directing a cleaning preparation at the pouch between the first end and the second end.

3. The method for filling of claim 2 further comprising the steps of:

positioning the pouch on a rotary filler having a plug removing station after the step of cleaning the external surfaces and the step of translating the pouch to the second end, a filling station and a plug replacement station, the stations being angularly displaced along the rotary filler;

rotating the pouch within the rotary filler after the step of removing from the plug removing station to the filling station; and rotating the pouch within the rotary filler after the step of filling from the filling station to the plug replacement station.

4. The method for filling of claim 3 further comprising the step:

rotating the pouch within the rotary filler after the step of replacing the plug prior to the step of removing.

5. The method for filling of claim 3 wherein the step of removing the plug further comprises the step of placing the plug proximate the pouch, so that, in turn, the plug rotates with the pouch on the rotary filler.

6. The method of claim 5 wherein the step of removing the plug further comprises pulling the plug from the spout, wherein the plug is coupled to the spout through an interference fit that forms a hermetic seal.

7. The method of claim 3 wherein the step of rotating the pouch within the rotary filler further comprises rotating the pouch through retention of the spout.

8. The method for filling of claim 1 wherein the step of coupling further comprises the steps of:

receiving the pouch on a rotary capper having a capping head;

rotating the pouch to the capping head prior to the step of coupling;

rotating the pouch away from the capping head after the step of coupling; and discharging the pouch from the rotary capper.

9. The method for filling of claim 8 wherein the step of coupling further comprises the step of rotatably coupling the cap to the spout, and the step of fixedly engaging the plug with the cap.

10. The method for filling of claim 1 wherein the step of providing the pouch further comprises the step of pre-sterilizing the cavity.

11. The method for filling of claim 10 wherein the step of pre-sterilizing the cavity further comprises the step of pre-sterilizing the cavity through at least one of gamma, x-ray and e-beam radiation.

12. A method for filling a plurality of aseptic pouches comprising the steps of:

providing a plurality of pouches, each pouch including a body having a plurality of panels that are coupled together to define a cavity, and, a spout providing ingress into the cavity, the spout having a plug sealingly engaged to the spout, thereby precluding access into the cavity;

cleaning the external surfaces of the plurality of pouches with a cleaning preparation;

sequentially directing the spout and the plug of each of the plurality of pouches into an aseptic zone, the aseptic zone having a supply of sterilized gas having a positive flow;

directing the plurality of the plurality of pouches into a rotary filler, the rotary filler having a plurality of plug removing stations, a plurality of filler stations, and a plurality of plug replacement stations;

firstly rotatably directing the plurality of pouches into one of the plurality of plug removing stations;

removing the plug in the plug removing stations substantially simultaneously;

secondly rotatably directing the plurality of pouches from the plug removing stations to the plurality of filler stations;

filling each of the plurality of pouches with a flowable material in the filler stations substantially simultaneously;

thirdly rotatably directing the plurality of pouches from the plurality of filler stations to the plurality of plug replacement stations;

replacing the plug on the spout of each of the plurality of pouches to seal each cavity in the plug replacement stations substantially simultaneously;

removing the plurality of pouches from the aseptic zone;

fourthly rotatably directing the plurality of pouches into a rotary capper, the rotary capper having a plurality of capping heads; and coupling the plug to the cap and to the spout in releasable engagement in the rotary capper, substantially simultaneously, whereupon removal of the cap simultaneously removes the plug and provides access to the cavity.

13. The method of claim 12 wherein the plurality of plug removing stations, the plurality of filler stations and the plurality of plug replacement stations comprises an identical quantity.

14. The method of claim 13 wherein the identical quantity comprises four.

15. The method of claim 14 wherein the plurality of capping heads comprises four capping heads.

16. The method of claim 12 wherein the step of removing the plug further comprises the step of:

placing each of the plurality of plugs adjacent a respective one of the plurality of pouches from which the plug was removed.

17. The method of claim 16 wherein the steps of secondly rotatably directing, and thirdly rotatably directing further comprises the steps of first and second rotatably directing the plug of each of the plurality of pouches.

18. The method of claim 12 wherein the step of coupling the plug further comprises the step of coupling the plug that was removed from each of the plurality of pouches on to the same pouch from where the respective plug was removed.

19. The method of claim 12 wherein the body of the pouch remains outside of the aseptic zone, while the spout and the plug are within the aseptic zone.

20. The method of claim 12 wherein the step of providing the pouch further comprises the step of pre-sterilizing the cavity.

* * * * *